US008513866B2

(12) United States Patent
Breidenassel et al.

(10) Patent No.: US 8,513,866 B2
(45) Date of Patent: Aug. 20, 2013

(54) SEMICONDUCTOR LAMP

(75) Inventors: Nicole Breidenassel, Bad Abbach (DE); Guenter Hoetzl, Regensburg (DE)

(73) Assignee: Osram AG, Munich (DE)

( * ) Notice: Subject to any disclaimer, the term of this patent is extended or adjusted under 35 U.S.C. 154(b) by 0 days.

(21) Appl. No.: 13/579,291

(22) PCT Filed: Mar. 18, 2011

(86) PCT No.: PCT/EP2011/054101

§ 371 (c)(1),
(2), (4) Date: Aug. 16, 2012

(87) PCT Pub. No.: WO2011/124457

PCT Pub. Date: Oct. 13, 2011

(65) Prior Publication Data

US 2013/0016512 A1 Jan. 17, 2013

(30) Foreign Application Priority Data

Apr. 7, 2010 (DE) ..... 10 2010 003 680

(51) Int. Cl.
*H01J 1/02* (2006.01)

(52) U.S. Cl.
USPC ..... 313/46; 362/249.01

(58) Field of Classification Search
USPC ..... 362/249.01; 313/46
See application file for complete search history.

(56) References Cited

U.S. PATENT DOCUMENTS

| | | | | |
|---|---|---|---|---|
| 7,157,838 | B2 * | 1/2007 | Thielemans et al. | 313/35 |
| 2003/0039122 | A1 | 2/2003 | Cao | |
| 2008/0024067 | A1 | 1/2008 | Ishibashi | |

FOREIGN PATENT DOCUMENTS

| | | | |
|---|---|---|---|
| DE | 102007021206 | A1 | 11/2008 |
| DE | 102007059471 | A1 | 6/2009 |
| EP | 2154419 | A2 | 2/2010 |
| JP | 2009016058 | A | 1/2009 |

OTHER PUBLICATIONS

English language abstract of JP 2009 016058 A.
English language abstract of DE 10 2007 021 206 A1.
English language abstract of DE 10 2007 059 471 A1.

* cited by examiner

*Primary Examiner* — Mary Ellen Bowman

(57) ABSTRACT

In various embodiments, a semiconductor lamp may include at least one semiconductor light source; a driver for operating the at least one semiconductor light source and at least one heat sink for cooling the at least one semiconductor light source and the driver; wherein the at least one heat sink may include a first heat sink, which is thermally connected to the at least one semiconductor light source and a second heat sink, which is thermally connected to the driver; wherein the first heat sink and the second heat sink are thermally insulated from one another.

17 Claims, 6 Drawing Sheets

SEMICONDUCTOR LAMP

RELATED APPLICATIONS

The present application is a national stage entry according to 35 U.S.C. §371 of PCT application No.: PCT/EP2011/054101 filed on Mar. 18, 2011, which claims priority from German application No. 10 2010 003 680.3 filed on Apr. 7, 2010.

TECHNICAL FIELD

Various embodiments relate to a semiconductor lamp, e.g. an incandescent retrofit lamp, having at least one semiconductor light source, a driver for operating the at least one semiconductor light source and at least one heat sink for cooling the at least one semiconductor light source and the driver.

BACKGROUND

DE 10 2007 059 471 A1 relates to a headlight lamp with a holder and a light output specified by international standards as regards distance and position in relation to a reference plane of the base, with the light being output by one or more semiconductor light sources. Operating electronics or a part of the operating electronics to operate the one or more semiconductor light sources can be disposed in the base of the headlight lamp. One or more semiconductor light sources can be disposed on a carrier structure with a first flat side and a second flat side in parallel to said first side.

SUMMARY

Various embodiments provide an option for particularly effective cooling of semiconductor lamps, e.g. retrofit lamps.

Various embodiments provide a semiconductor lamp having at least one semiconductor light source, a driver for operating the at least one semiconductor light source and at least one heat sink for cooling the at least one semiconductor light source and the driver, wherein the at least one heat sink includes a first heat sink which is thermally connected to the at least one semiconductor light source and a second heat sink which is thermally connected to the driver, wherein the first heat sink and the second heat sink are thermally insulated from one another.

The use of thermally insulated heat sinks for the semiconductor light source(s) and the driver enables thermal influencing, especially of the more sensitive components, e.g. of the driver by the thermally insensitive components, e.g. the semiconductor light source, to be kept low. Thus, for example a majority of the thermal power dissipation can occur at the semiconductor light sources. The thermal separation of heat sinks or heat sink parts makes the driver cooling independent of the light source cooling and thus enables it to be set to a lower temperature level. For temperature-sensitive parts in the driver, such as integrated circuit chips or electrolytic capacitors, there is a greater temperature difference for heat removal, so that additional measures, such as the use of heat pads for example, can be dispensed with. The lower temperatures at the driver for example mean that its likelihood of failure is also reduced and its lifetime is extended. The concept of the divided or thermally-separated heat sink can be used both for passively cooled lamps and also for actively cooled lamps.

Thermal insulation of the heat sinks can be present if a boundary surface is available which is not designed by means of a corresponding connection and/or choice of material for a significant heat flow. In other words thermal installation of the heat sinks can be present for example if there is a temperature difference between the adjoining heat sinks in the area of the boundary surface.

The degree of thermal insulation can differ according to the embodiment. To achieve a thermal separation of the two heat sinks an air gap and/or a material with poor thermal conductivity, an adhesive bond with poor thermal conductivity, a tape with poor thermal conductivity, a paste with poor thermal conductivity, a sealing material such as silicon/PU or a plastic with poor thermal conductivity can be provided between them for example. In order to guarantee an air gap suitable spacer pins or rough areas could be provided for example on the connection surfaces of the two heat sinks.

In an embodiment with a first heat sink with good thermal conductivity, made of metal for example, and a second heat sink with far worse thermal conductivity in relation to the first heat sink, made of plastic for example, a sufficient thermal insulation of the two heat sinks can also be achieved with direct material contact between the two heat sinks, with the reason for this being that the heat of the first heat sink is dissipated to air rather than to the second heat sink with worse thermal conductivity and thus heating up of the driver electronics by the power dissipation of the light source is reduced or prevented.

For example it can be assumed that there is thermal insulation if

- a gap between the two heat sinks is filled with at least a heat insulating material with a thermal conductivity of 1 W/(m·K) or less, especially of not more than 0.5 W/(m·K), especially of not more than 0.3 W/(m·K), especially of not more than 0.1 W/(m·K), e.g. air or a few plastics or adhesives; and/or
- a difference in the thermal conductivity between the two heat sinks amounts, at least in the area of the boundary surface(s), to a factor of 10, e.g. for a first heat sink made from an aluminum-magnesium alloy with approximately 50 W/(m·K) and a second heat sink made from plastic with not more than 5 W/(m·K). For the difference in the thermal conductivity by at least a factor of 10 there does not need to be any gap present between the two heat sinks, but there can be one for even better heat insulation.

It is especially preferred for the gap to be filled with a combination of at least one air gap and at least one thermally-insulating material in the order air gap/thermally-insulating material/air gap.

For a compact embodiment of the semiconductor lamp a preferred development can be for the smallest distance between the two heat sinks to amount to approximately 5 mm or less, especially 3 mm or less, especially 1 mm or less.

The semiconductor lamp can especially be a retrofit lamp, especially an incandescent retrofit lamp. However the semiconductor lamp is not restricted to this but can also be a halogen retrofit lamp, especially with a flat front side.

Preferably the at least one semiconductor light source includes at least one light emitting diode. If a number of light emitting diodes are present, these can illuminate in the same color or in different colors. A color can be monochrome (e.g. red, green, blue etc.) or multichrome (e.g. white). The light radiated by the at least one light emitting diode can also be an infrared light (IR-LED) or ultraviolet light (UV-LED). A number of light emitting diodes can generate a mixed light; e.g. a white mixed light. The at least one light emitting diode may contain at least one wavelength-converting illuminant (conversion LED). The at least one light emitting diode can be present in the form of at least one individually housed light emitting diode or in the form of at least one LED chip (multichip LED). A number of LED chips can be mounted on a common substrate ("submount"). The at least one light emitting diode may be equipped with at least one separate and/or shared optics unit for beam guidance, e.g. at least one Fresnel lens, collimator and so forth. Instead of or in addition to an organic light emitting diode, e.g. based on InGaN or AlInGaP, organic LEDs (OLEDs, e.g. polymer OLEDs) are also able to be used. A diode laser can be used for example as another semiconductor light source.

The driver (also referred to as driver electronics, operating electronics or ballast electronics) may be divided into one or more components and can be disposed for example on a driver circuit board.

The first heat sink and the second heat sink may also be seen as parts of a single heat sink, thermally insulated from one another.

An embodiment is that the first heat sink and the second heat sink each have cooling projections, especially cooling ribs, wherein the cooling projections of the two heat sinks engage into one another. This allows the two heat sinks or heat sink parts to be in contact with cool, fresh air without lying in a heated air area of the other respective heat sink. This applies regardless of whether the lamp is operated in a "light downwards" or "light upwards" orientation. In the "light downwards" orientation in this case, with an incandescent retrofit lamp for example, the cooling fresh air may initially flow around the lamp bulb through free convection and then afterwards reach the two heat sinks almost simultaneously, which then have contact with the fresh air at around room temperature. In this case the overall heat sink volume available can be divided up accordingly, depending on the individual cooling requirement for the semiconductor light sources and the driver electronics.

Another embodiment is that the semiconductor lamp has at least one fan for generating an air flow at the first heat sink and/or at the second heat sink. This enables the cooling power to be greatly increased. The fan can thus essentially only generate an air flow at the first heat sink, essentially only at the second heat sink or at both heat sinks.

A further embodiment is that the first heat sink and the second heat sink are disposed in an exhaust area of the fan. The air can be sucked in for example through an air gap between the two heat sinks.

Another embodiment is that the second heat sink is disposed in an induction area of the fan and the first heat sink in an exhaust area of the fan. Because typically only a small part of the dissipated heat of the lamp occurs at the driver, the first heat sink for the semiconductor light sources is only slightly preheated by the second heat sink.

It is also an embodiment that one of the heat sinks, especially the second heat sink, has at least one induction opening or air inlet opening for sucking in air therethrough or guiding air to the fan. This enables an easy-to-cool and especially compact semiconductor lamp to be achieved.

A further embodiment is that the fan is configured and disposed for cooling the first heat sink or the second heat sink, in this case it can be ensured that the heat sink with the greater cooling requirement (in a typical case the heat sink thermally connected to the semiconductor light source(s)) is explicitly actively cooled with the fan and spatially separated from it (e.g. rotated at an angle of 90° to it) the heat sink with the lower cooling requirement (e.g. for the driver) still makes do with passive cooling (free convection). This makes an especially simple and compact embodiment of active cooling possible, e.g. with an especially small and low-cost fan.

An additional embodiment is that the first heat sink and the second heat sink are thermally insulated from one another at least in some areas by means of at least one air gap. This produces good thermal insulation and saves a dedicated insulation material having to be used.

Another embodiment is that the first heat sink and the second heat sink are fixed spaced from one another by at least one spacer. This enables an air gap to be set precisely and the heat sinks can be connected to one another in a simple and mechanically stable manner.

A further development is that the fan sucks in air through the at least one air gap and blows the air out through the cooling structure of the first heat sink.

A further embodiment is that the first heat sink and the second heat sink are thermally insulated from one another at least in some areas by means of at least one layer of plastic. This produces an especially stable connection and prevents dirt penetrating between the two heat sinks.

It is also an embodiment for the cooling projections, especially cooling ribs (but also cooling pins, cooling fins etc.) to be aligned at right angles and for the cooling projections of the first heat sink and the cooling projections of the second heat sink to engage alternately with one another in a circumferential direction. In particular with intermeshed heat sinks which sit in an exhaust area of a fan, cool fresh air reaches both heat sink parts simultaneously, which enables preheating of the cooling air to be avoided. With an appropriate arrangement of the fan the intermeshed two heat sinks may also be disposed in an induction area of the fan. This enables the overall cooling surface to be enlarged and cooling power to be increased. Alignment at right angles may especially be understood as an alignment in which the cooling projections essentially lie in a plane in which the longitudinal axis of the semiconductor lamp also lies.

An additional embodiment is that the cooling projections, especially cooling ribs of the two heat sinks, engage with one another in groups, especially in sectors. In the circumferential direction this means that especially groups of cooling projections of the first heat sink alternate with groups of cooling projections of the second heat sink, for example the groups can be located in corresponding sectors or on corresponding sides, e.g. rotated by about 90° at right angles to the longitudinal axis or for a heat sink opposite in relation to the others heat sink rotated by around 90° about the longitudinal axis.

A further embodiment is that the cooling projections, especially cooling ribs, of the first heat sink and the cooling projections, especially cooling ribs, of the second heat sink (e.g. in the longitudinal direction) are disposed merging into one another and are separated from one another (horizontal division) by a plane (horizontal plane) lying essentially at right angles to the longitudinal axis of the semiconductor lamp. This makes it possible to manufacture the semiconductor lamp in especially simple manner. As an alternative or in addition a vertical division with a vertical separation plane essentially lying in parallel to the longitudinal axis is possible.

It is also an embodiment for the semiconductor lamp to be an incandescent retrofit lamp and wherein a light-permeable bulb is attached to the first heat sink and the second heat sink is attached to a base.

In general terms one of the heat sinks, especially the first heat sink, may consist of an electrically conductive material, especially metal, e.g. aluminum and/or copper, for especially good heat removal but e.g. also from an electrically and thermally conductive plastic. As an alternative the heat sink may also feature electrically insulating, but thermally conducting plastic or ceramic. In this case the semiconductor light source does not need to be especially electrically insulated from the first heat sink. A thermal conductivity capability of this heat sink may amount to especially at least 5 W/(m·K), especially more than 15 W/(m·K), especially more than 20 W/(m·K), especially more than 50 W/(m·K).

In general terms one of the heat sinks, especially the second heat sink, can consist of a thermally conductive and electrically insulating material, e.g. corresponding plastics or ceramic. This enables the driver to be sufficiently cooled and electrically insulated. A thermal conductivity of this heat sink may especially amount to between 1 and 2.5 W/(m·K), preferably appr. 3.5 to appr. 5 W/(m·K), especially preferably more than 5 W/(m·K).

BRIEF DESCRIPTION OF THE DRAWINGS

In the following figures the invention will be described in greater detail in schematic diagrams which refer to exemplary embodiments. In these diagrams, for the sake of clarity, elements which are the same or function in the same way can be provided with the same reference characters.

DETAILED DESCRIPTION

The following detailed description refers to the accompanying drawings that show, by way of illustration, specific details and embodiments in which the invention may be practiced.

Figure 1:
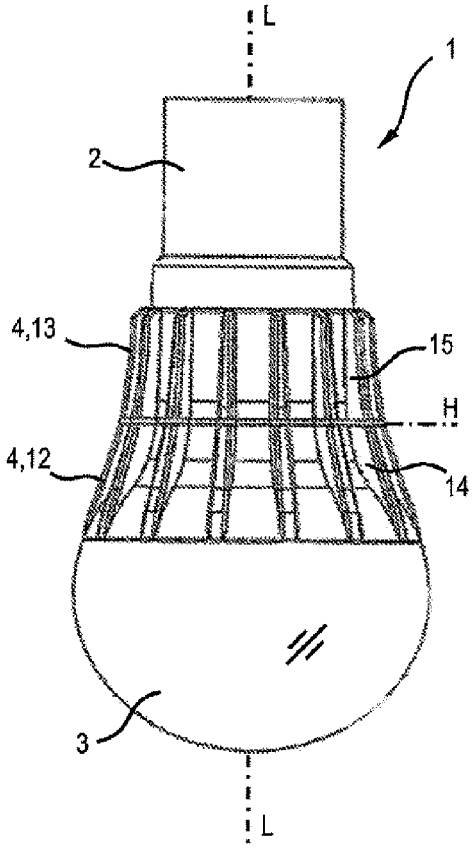
FIG. 1 shows a side view of a semiconductor lamp in accordance with a first embodiment in an orientation directed downwards.
Figure 2:
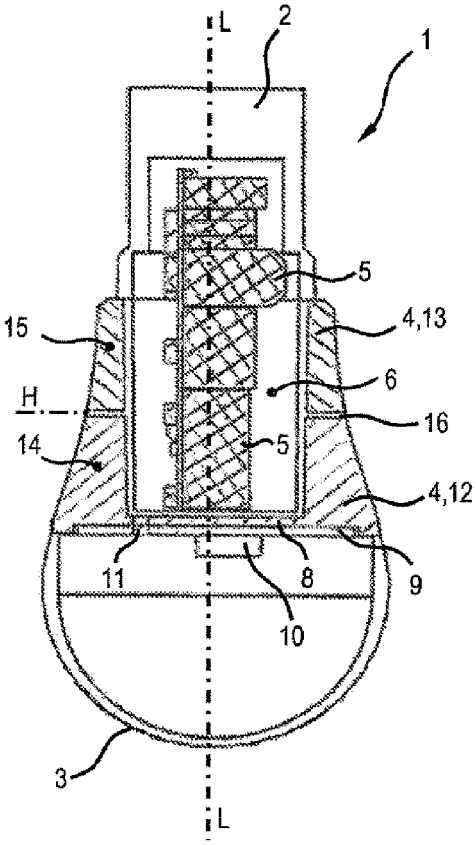
FIG. 2 shows the semiconductor lamp in accordance with the first embodiment as a sectional diagram viewed from the side.

FIG. 1 shows a side view of a semiconductor lamp 1, which is embodied as an incandescent retrofit lamp. FIG. 2 shows the semiconductor lamp 1 as a sectional diagram viewed from the side.

The semiconductor lamp 1 has roughly the external shape of a conventional incandescent lamp, including a base 2 for electrical connection of the semiconductor lamp 1 by connecting it to a suitable holder of a light fitting (upper diagram) as well as a bulb 3 which allows the passage of light. The bulb 3 may be embodied transparent or opaque (diffuse). The semiconductor lamp 1 is shown here oriented downwards, whereby light radiation through the bulb 3 essentially into a lower half space ("light downwards") is made possible. The tip of the bulb 3 represents a front-end of the semiconductor lamp, and the base 2 corresponds to a rear end or area of the semiconductor lamp 1. The semiconductor lamp 1 also has a longitudinal axis L around which it essentially exhibits a rotationally-symmetrical basic shape.

Between the base 2 and the bulb 3 is located a housing 4 in which at least a part of a driver 5 is accommodated. The housing 4 forms a cavity 6 for this purpose which, as shown in FIG. 2, is continued into the base 2. This cavity 6 is closed off at its front side by a divider plate 8 of the housing 4.

Located on a front side of the divider plate 8 of the housing 4 is a printed circuit board 9, which is equipped with at least one light emitting diode 10 as the semiconductor light source. In more precise terms, the rear side of the circuit board 9 lies against the surface of the divider plate 8, in order to make good heat transmission possible, and is equipped on its front side with at least one LED 10. To pass electrical leads through from the driver 5 to the printed circuit board 9 or the at least one LED 10, a cable passthrough 11 connecting the cavity 6 and the front side of the board 9 is present. The bulb is at an outer edge of the front side of the housing 4 seated so that it arches over the entire front side of the housing, including the at least one LED 10.

The base 2 is not restricted to a specific type of base but can for example be embodied as an Edison base, a bayonet base, a plug-in base etc.

The housing 4 has a heat sink structure on its outer side.

With a conventional LED lamp the housing is manufactured in one piece from a material with good conductivity, e.g. aluminum, and may have cooling ribs on its outer side. During operation of such an LED lamp the heat sink is heated up by the waste heat of the at least one LED, which is transmitted to it via the circuit board. At the same time the driver gives off heat. Frequently the emission of heat by the at least one LED is significantly higher than the emission of heat by the driver, this means that the housing may be heated up so much that a temperature difference between the driver and the housing becomes too small for effective cooling of the driver or in extreme cases the driver is even heated up further by this housing.

In the present inventive semiconductor lamp 1, to avoid overheating of the driver 5, the housing 4 is divided up into a first heat sink 12 and a second heat sink 13, which are in practice thermally insulated from one another. The semiconductor lamp 1, the first heat sink 12 and the second heat sink 13 are separated from one another along a horizontal plane H which lies at right angles to the longitudinal axis L. The bulb 3 is thus attached to the first heat sink 12, while the base 2 is attached to the second heat sink 13. The cavity 6 is formed by the first heat sink 12 and the second heat sink 13. Depending on the cooling requirement of the driver 5 or the light emitting diode 10, the separation plane may be displaced along the longitudinal axis L. The first heat sink 12 and the second heat sink 13 are each equipped on their outer side with cooling ribs 14 or 15, which are respectively aligned essentially at right angles and are located spaced equally in the circumferential direction around the longitudinal axis L. The cooling ribs 14, 15 are disposed adjoining one another, with an upper edge of the cooling rib 15 adjoining a lower edge of the cooling rib 14. As an alternative it may be advantageous for the adjoining cooling ribs 14 and 15 to be offset in relation to one another. The cooling ribs 14 and 15 may also engage offset into one another, e.g. like a comb.

The two heat sinks 12, 13 may also be seen as parts of a single heat sink divided into two.

The first heat sink 12 and the second heat sink 13 are thermally insulated from one another by a plastic layer 16 with poor thermal conductivity being located between them, which also provides cladding for the cavity 6 to establish sufficient creepage gaps and air gaps and insulates the heat sinks 12, 13 electrically from the driver 5. Instead of the plastic layer, the first heat sink 12 and the second heat sink 13 may also be separated from one another by an air gap; the cavity 6 may then still be clad with a plastic layer, e.g. a plastic sleeve.

This semiconductor lamp 1 has the advantage of the driver 5 now only being affected to a small extent by the dissipated heat of the at least one LED 10. In the area of the second heat sink 13 the temperature difference to the driver 5 and thus the transmission of heat from the driver 5 to the second heat sink 13 is greater than with a one-piece housing or heat sink. The simple geometrical division shown between the first heat sink 12 and the second heat sink 13 makes simple manufacturing and installation possible. As an alternative to the horizontal division between the heat sinks 12, 13, in addition or as an alternative, a vertical division (in parallel to the longitudinal axis L) may also be undertaken.

Figure 3:
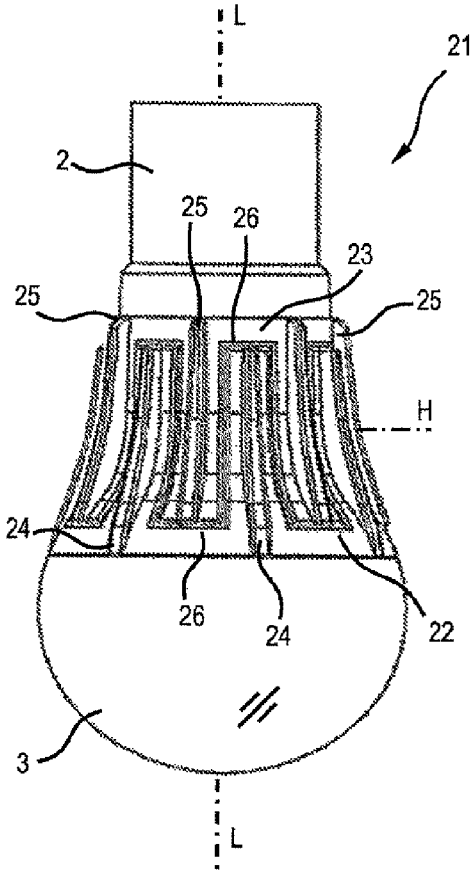
FIG. 3 shows a side view of a semiconductor lamp in accordance with a second embodiment with orientation directed downwards.
Figure 4:
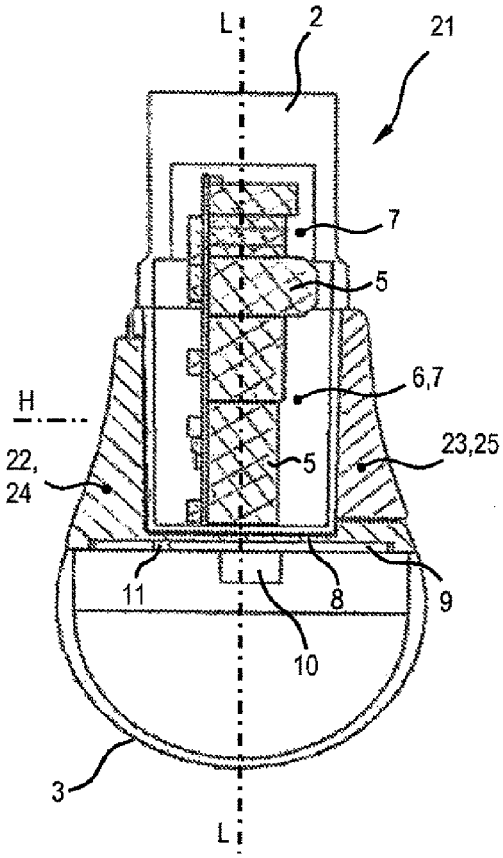
FIG. 4 shows the semiconductor lamp in accordance with a second embodiment as a sectional diagram viewed from the side.

FIG. 3 shows a side view of a semiconductor lamp 21 in accordance with a second embodiment. FIG. 4 shows the semiconductor lamp 21 as a sectional diagram viewed from the side. The semiconductor lamp 21 is an incandescent retrofit lamp and is constructed in a similar way to the semiconductor lamp 1 in accordance with the first exemplary embodiment. However the first heat sink 22 and the second heat sink 23 are now no longer divided along a horizontal plane H, but each have continuous cooling ribs 24 or 25 aligned at right angles. The cooling ribs 24 and 25 are each directed at right angles and like crenellations or a comb in the direction of the respective other heat sink 23 or 22, so that, when the semiconductor lamp 21 is assembled, they engage into each other in the circumferential direction, but without touching each other. The first heat sink 22 and the second heat sink 23 and the cooling ribs 24 or 25 are also thermally insulated from one another, e.g. by a plastic layer 26 or an air gap. The crenellated or comb-like intermeshing of the cooling ribs 24 and 25 means that each of the cooling ribs 24, 25 may be sufficiently supplied with cooling air independently of an orientation or spatial position of the semiconductor lamp 21, so that a sufficient cooling of the at least one LED 10 and of the driver 5 may be ensured. For example for the downwards-aligned "light downwards" orientation shown in FIG. 3 and FIG. 4, cooling air may flow along both cooling ribs 24, 25 without said air having been heated up beforehand by the other type of cooling ribs 24 or 25.

Figure 5:
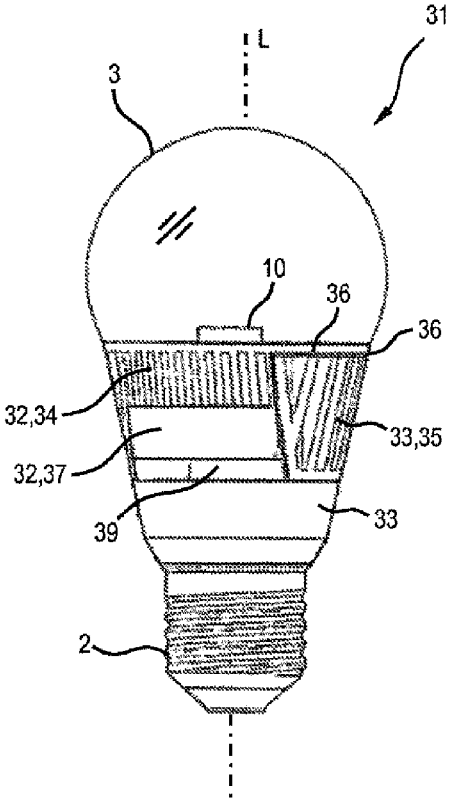
FIG. 5 shows a side view of a semiconductor lamp in accordance with the third embodiment in an orientation directed upwards.
Figure 6:
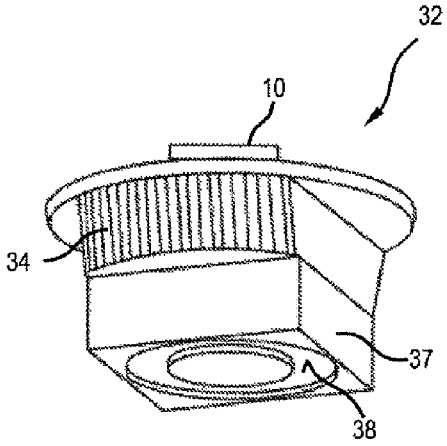
FIG. 6 shows a view from obliquely below a first heat sink of the semiconductor lamp in accordance with the third embodiment.

FIG. 5 shows a side view of a semiconductor lamp 31 with an upwards alignment in accordance with a "light upwards" orientation. The semiconductor lamp 31 now has a first heat sink 32, to the lower end of which a fan 37 is attached. FIG. 6 shows the first heat sink 32 with the fan 37 in an oblique view. Air is sucked in from an underside 38 of the fan 37 serving as an induction side and is blown out again through cooling ribs 34 spaced apart from one another. This enables a strong forced air flow to be generated past the cooling ribs 34, which produces very good cooling. This is especially advantageous in the cooling of the light emitting diode 10 emitting a high degree of dissipated heat. The first heat sink 32 is, however, not equipped along its entire circumferential direction with the cooling ribs 34, but only on two opposing sides or sectors.

In the semiconductor lamp 31 the air is sucked into the underside 38 of the fan 37 through a wide air gap 39 between the first heat sink 32 and the second heat sink 33. The second heat sink 33 is thus practically also not cooled by the fan 37, but this is also not necessary because of the comparatively lower heat radiation of the driver 5. This enables a comparatively compact, energy-saving and low-cost fan 37 to be used. Of the two heat sinks 32, 33 the first heat sink 32 is thus able to be actively cooled and the second heat sink 33 is essentially only able to be passively cooled.

Figure 7:
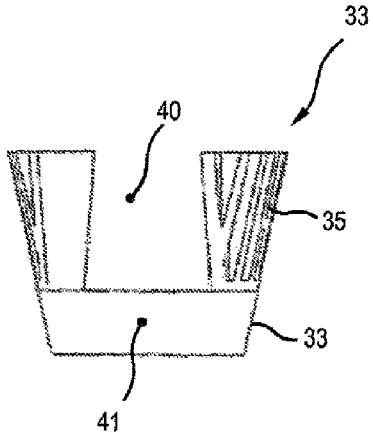
FIG. 7 shows a side view of a second heat sink of the semiconductor lamp in accordance with the third embodiment.

For assembling the two heat sinks 32, 33 the second heat sink 33, as also shown in FIG. 7, features an upper recess 40 into which the first heat sink 32 can be inserted. In this case an air gap or a layer of plastic 36 is located between the two heat sinks 32, 33. The recess 40 is formed to the side by two groups of cooling ribs 35 lying opposite one another. The cooling ribs 34 of the first heat sink 32 and the cooling ribs 35 of the second heat sink 33 thus adjoin each other as a respective side or group in the circumferential direction, but are rotated in relation to the longitudinal axis L by 90° in respect of one another.

Below the cooling ribs 35 is located a receptacle 41 in the second heat sink 33 for accommodating the driver 5.

Figure 8:
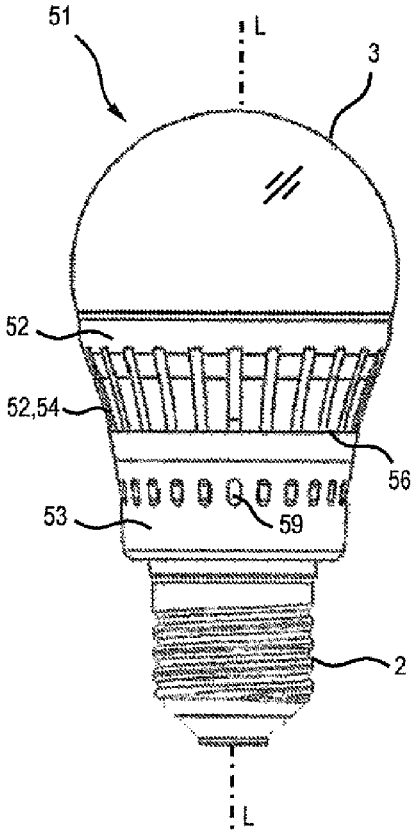
FIG. 8 shows a side view of a semiconductor lamp in accordance with a fourth embodiment.
Figure 9:
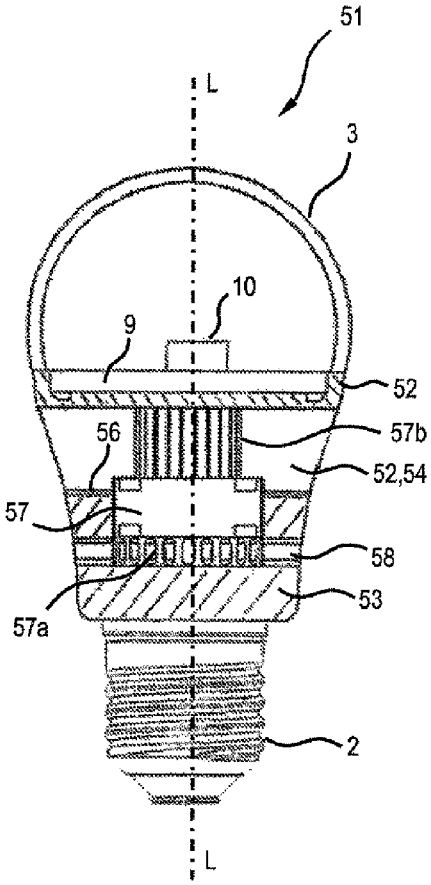
FIG. 9 shows the semiconductor lamp in accordance with the fourth embodiment as a sectional diagram viewed from the side.

FIG. 8 shows a side view of a semiconductor lamp 51 in accordance with a fourth embodiment. FIG. 9 shows the semiconductor lamp 51 as a side view in a sectional diagram.

The semiconductor lamp 51 has a first heat sink 52 which in the circumferential direction has cooling ribs or cooling bars 54 running all around it. The cooling bars 54 surround at least one exhaust area 57*b* of a fan 57, so that the fan 57 can blow out air between the cooling bars 54 and thus make possible forced cooling of the first heat sink 52.

An induction area 57*a* of the fan 57 is surrounded by the second heat sink 53, wherein the induction area 57*a* is connected for air flow by one or more air channels 58 to air inlet openings 59 in the second heat sink 53. During operation of the fan 57 cooling air is sucked from outside through the air inlet openings 59 and through the air channels 58 to the induction area 57*a*, through which the second heat sink 53 is also cooled slightly. Here too the first heat sink 52 and the second heat sink 53 are thermally separated from one another by an insulation layer 56, also plastic or an air gap for example.

Figure 10:
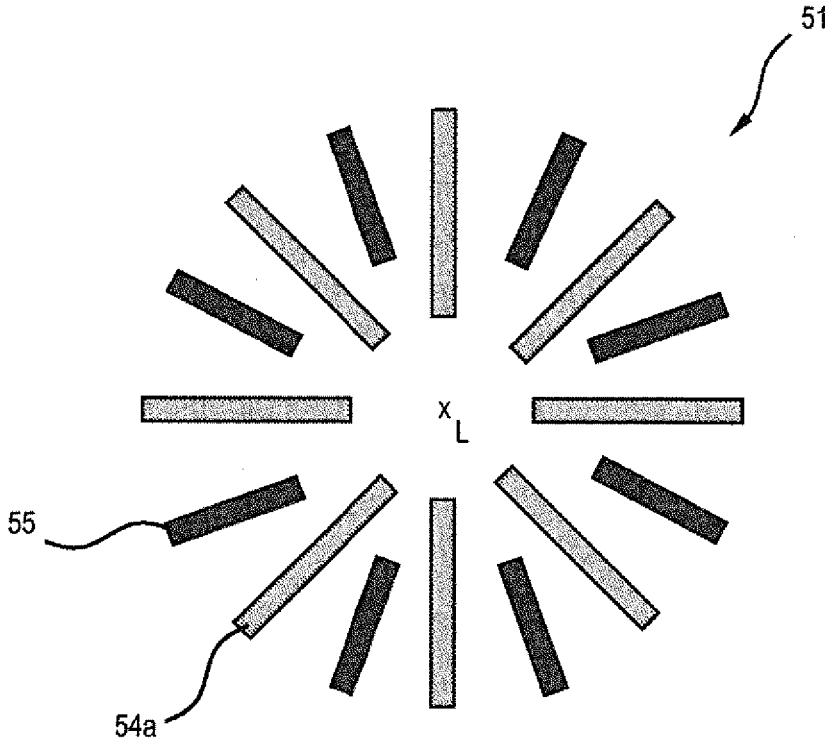
FIG. 10 shows, as a sectional diagram viewed from above, an arrangement of cooling ribs of the semiconductor lamp in accordance with the fourth embodiment.

FIG. 10 shows a sectional diagram from above of a possible arrangement of cooling ribs 54*a* of the first heat sink 52 and of optionally present cooling ribs 55 of the second heat sink 53 of the semiconductor lamp 51. The cooling ribs 54*a* and 55 engage with one another radially in a comb arrangement. This enables an increased cooling requirement of the second heat sink 53 to be met.

Figure 11:
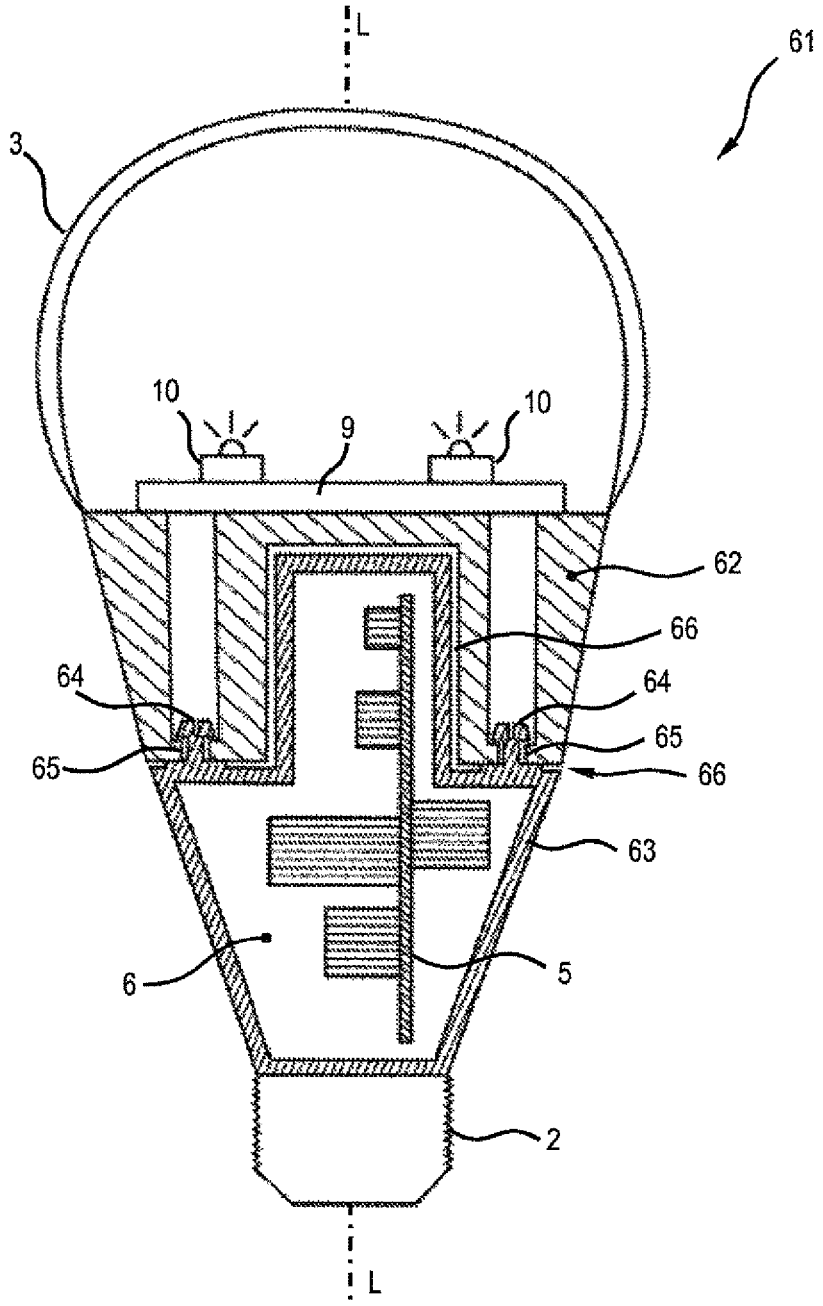
FIG. 11 shows, as a sectional diagram viewed from the side, a semiconductor lamp aligned upwards in accordance with a fifth embodiment.

FIG. 11 shows a sectional diagram viewed from the side of a semiconductor lamp 61 in accordance with a fifth embodiment. The first heat sink 62 and the second heat sink 63 are insulated thermally from one another by an air gap 66. To realize the mechanical fixing of the two heat sinks 62, 63 to one another, the lower, second heat sink 63 has a number of spacer bolts 64 equipped with latching hooks which can latch or snap into a corresponding latching cutouts 65 of the first heat sink 62 and retain the latter.

Naturally the present invention is not restricted to the exemplary embodiment shown.

Thus the cavity 6 for accommodating the driver 5 (driver cavity) can generally protrude into the base 2, or the base 2 might not contribute to forming the cavity.

Also for example the provision of a defined gap 16 between the heat sinks may be dispensed with in the semiconductor lamp 1 and these may also touch each other, e.g. within a manufacturing tolerance. To maintain a thermal insulation between the two heat sinks, the first (front) heat sink can consist for example of a material with far better conductivity, e.g. an aluminum alloy with a thermal conductivity of more than 50 W/(m·K) than the second (rear) heat sink, which may consist for example a plastic with a thermal conductivity of not more than 1 W/(m·K). Then the heat present in the first heat sink, despite mechanical contact between the two heat sinks, may essentially not be emitted to the air and not transmitted to the second heat sink.

While the invention has been particularly shown and described with reference to specific embodiments, it should be understood by those skilled in the art that various changes in form and detail may be made therein without departing from the spirit and scope of the invention as defined by the appended claims. The scope of the invention is thus indicated by the appended claims and all changes which come within the meaning and range of equivalency of the claims are therefore intended to be embraced.

LIST OF REFERENCE CHARACTERS

1 Semiconductor lamp
2 Base
3 Bulb
4 Housing
5 Driver
6 Cavity
8 Dividing plate
9 Circuit board
10 LED
11 Cable passthrough
12 First heat sink
13 Second heat sink
14 Cooling rib
15 Cooling rib
16 Plastic layer
21 Semiconductor lamp
22 First heat sink
23 Second heat sink
24 Cooling rib
25 Cooling rib
26 Plastic layer
31 Semiconductor lamp
32 First heat sink
33 Second heat sink
34 Cooling rib
35 Cooling rib
36 Plastic layer
37 Fan
38 Underside of the fan
39 Air gap
40 Recess
41 Receptacle
51 Semiconductor lamp
52 First heat sink
53 Second heat sink
54 Cooling bars
54*a* Cooling rib
55 Cooling rib
56 Insulation layer
57 Fan
57 *a* Induction area
57*b* Exhaust area
58 Air channel
59 Air outlet opening
61 Semiconductor lamp
62 First heat sink
63 Second heat sink
64 Spacer bolts
65 Latching cutout
66 Air gap
L Longitudinal axis
H Horizontal plane

The invention claimed is:

1. A semiconductor lamp, comprising:
at least one semiconductor light source;
a driver for operating the at least one semiconductor light source and at least one heat sink for cooling the at least one semiconductor light source and the driver;
wherein the at least one heat sink comprises a first heat sink, which is thermally connected to the at least one semiconductor light source and a second heat sink, which is thermally connected to the driver;
wherein the first heat sink and the second heat sink are thermally insulated from one another.

2. The semiconductor lamp as claimed in claim 1, wherein the first heat sink and the second heat sink each have cooling projections, wherein the cooling projections of the two heat sinks engage into one another.

3. The semiconductor lamp as claimed in claim 1,
wherein the semiconductor lamp has at least one fan for generating a flow of air at least one of at the first heat sink and at the second heat sink.

4. The semiconductor lamp as claimed in claim 3,
wherein the first heat sink and the second heat sink are disposed in an exhaust area of the fan.

5. The semiconductor lamp as claimed in claim 3, wherein the second heat sink is disposed in an induction area of the fan and the first heat sink in an exhaust area of the fan.

6. The semiconductor lamp as claimed in claim 5, wherein the second heat sink has at least one induction opening for sucking air into the fan.

7. The semiconductor lamp as claimed in claim 3, wherein the fan is configured and disposed for cooling the first heat sink or the second heat sink.

8. The semiconductor lamp as claimed in claim 1,
wherein the first heat sink and the second heat sink are thermally insulated from one another, at least in some areas, by means of at least one air gap.

9. The semiconductor lamp as claimed in claim 8, wherein the first heat sink and the second heat sink are fixed at a distance from one another by at least one spacer.

10. The semiconductor lamp as claimed in claim 7,
wherein the first heat sink and the second heat sink are thermally insulated from one another, at least in some areas, by means of at least one air gap;
wherein the fan sucks in air through the at least one air gap and blows it out through the cooling structure of the first heat sink.

11. The semiconductor lamp as claimed in claim 1,
wherein the first heat sink and the second heat sink are thermally insulated from one another, at least in some areas, by means of at least one plastic layer.

12. The semiconductor lamp as claimed in claim 2,
with the cooling projections being aligned at right angles and the cooling projections of the first heat sink and the cooling projections of the second heat sink engaging alternately with one another.

13. The semiconductor lamp as claimed in claim 2, with the cooling projections of the two heat sinks engaging into one another in groups.

14. The semiconductor lamp as claimed in claim 2, with the cooling projections of the first heat sink and the cooling projections of the second heat sink being disposed merging into one another and being separated from one another by a plane essentially at right angles to a longitudinal axis of the semiconductor lamp.

15. The semiconductor lamp as claimed in claim 1, wherein the semiconductor lamp is an incandescent retrofit lamp and wherein a bulb permeable to light is attached to the first heat sink and a base is attached to the second heat sink.

16. The semiconductor lamp as claimed in claim 1, configured as an incandescent retrofit lamp.

17. The semiconductor lamp as claimed in claim 12, with the cooling projections comprise cooling ribs.

* * * * *